US007932483B2

(12) United States Patent
Bronstering et al.

(10) Patent No.: US 7,932,483 B2
(45) Date of Patent: Apr. 26, 2011

(54) HOUSEHOLD APPLIANCE WITH AN ELECTRIC CONTROL SYSTEM AND AN ACCESSORY PART

(75) Inventors: Hermann Bronstering, Wadersloh (DE); Hans-Gerd Holtdirk, Lippstadt (DE); Helmut Kindler, Beelen (DE); Jürgen Scharmann, Herzebrock-Clarholz (DE)

(73) Assignee: Miele & Cie. KG, Gutersloh (DE)

( * ) Notice: Subject to any disclaimer, the term of this patent is extended or adjusted under 35 U.S.C. 154(b) by 1038 days.

(21) Appl. No.: 11/567,621

(22) Filed: Dec. 6, 2006

(65) Prior Publication Data

US 2007/0133344 A1 Jun. 14, 2007

(30) Foreign Application Priority Data

Dec. 8, 2005 (DE) ..... 10 2005 058 996

(51) Int. Cl.
*H05B 1/02* (2006.01)

(52) U.S. Cl. ..... 219/516; 219/494; 219/497; 219/713; 340/572.8

(58) Field of Classification Search ..... 219/494, 219/497, 505, 535, 553, 712, 713, 516; 340/572.8; 307/39–42; 235/385
See application file for complete search history.

(56) References Cited

U.S. PATENT DOCUMENTS

2008/0008143 A1* 1/2008 Robertson et al. ..... 370/338
2008/0165013 A1* 7/2008 Harper et al. ..... 340/572.8

FOREIGN PATENT DOCUMENTS

DE 3641659 C1 6/1988
DE 4421373 A1 12/1995
DE 10317682 A1 10/2004
EP 1239703 A2 9/2009

* cited by examiner

*Primary Examiner* — Mark H Paschall
(74) *Attorney, Agent, or Firm* — Fox Rothschild LLP; Gerard P. Norton; Christopher R. Kinkade

(57) ABSTRACT

The invention relates to a household appliance with an electric control system (20), which is connected to an accessory part (12) for the household appliance in a signal-transmitting fashion, wherein the accessory part (12) can be moved back and forth between an active position and a resting position on the household appliance and, in the switched-on state of the household appliance, exchanges signals for controlling the household appliance with the electric control system (20), at least in the active position.

In order to specify a household appliance in which the accessory part, in its resting position, is stored in the household appliance in such a way that the user can access the household appliance without obstruction and, at the same time, a high degree of security against malfunction is guaranteed, the signal exchange between the transmission or transmission/reception device (17) of the accessory part (12) and the electric control system (20) occurs wirelessly and the accessory part (12), in its resting position, is mounted in a storage element (6) of the household appliance at least partly consisting of an electrically conductive material, said storage element electrically shielding the transmission or transmission/reception device (17) of the accessory part (12) from the electric control system (20) so that signal exchange is prevented.

16 Claims, 1 Drawing Sheet

HOUSEHOLD APPLIANCE WITH AN ELECTRIC CONTROL SYSTEM AND AN ACCESSORY PART

FIELD OF THE INVENTION

The invention relates to a household appliance such as an oven having an electric control system and an accessory in wireless communication therewith.

BACKGROUND OF THE INVENTION

A household appliance of this nature is disclosed in DE 36 41 659 C1. The known household appliance is designed as a heat treatment device for food and has an electric control system that is connected, via a signal-transmitting cable, to an accessory part for the household appliance, the accessory part being designed as a sensor. The accessory part can be moved back and forth between an active position and a resting position on the household appliance and, in the switched-on state of the household appliance, exchanges signals for controlling the household appliance with the electric control system, at least in the active position.

In addition, a household appliance designed as a cooking device, in which the signal exchange between the accessory part and an electric control system of the household appliance also occurs wirelessly, is known from EP 1 239 703 A2.

DE 103 17 682 A1 discloses a device for protecting data from mobile transponders, wherein the device has a shield covering at least the antenna of the transponder for attenuation of electrostatic, magnetostatic or electromagnetic fields.

Also described in DE 44 21 373 A1 is an accessory part designed as a sensor element that wirelessly exchanges signals with an electric control system of a cooking device. To this end, the antenna of the sensor element is designed to pass through the metal housing to a non-shielded end of the sensor element.

The problem solved by the invention, therefore, is to specify a household appliance in which the accessory part, in its resting position, is stored on the household appliance in such a way that the user can, as a result, access the household appliance without obstruction and, at the same time, a high degree of security against malfunction is guaranteed.

According to the invention, this problem is solved by a household appliance having the features of claim 1. Advantageous embodiments and developments of the invention result from the ensuing dependent claims.

SUMMARY OF THE INVENTION

The invention relates to a household appliance with an electric control system, which is connected to an accessory part for the household appliance in a signal-transmitting fashion, wherein the accessory part can be moved back and forth between an active position and a resting position on the household appliance and, in the switched-on state of the household appliance, exchanges signals for controlling the household appliance with the electric control system, at least in the active position.

In order to specify a household appliance in which the accessory part, in its resting position, is stored in the household appliance in such a way that the user can access the household appliance without obstruction and, at the same time, a high degree of security against malfunction is guaranteed, the signal exchange between the transmission or transmission/reception device of the accessory part and the electric control system occurs wirelessly and the accessory part, in its resting position, is mounted in a storage element of the household appliance at least partly consisting of an electrically conductive material, said storage element electrically shielding the transmission or transmission/reception device of the accessory part from the electric control system so that signal exchange is prevented.

The advantages achievable with the invention consist, in addition to the user's unobstructed access to the household appliance while the accessory part is in its resting position, particularly in the fact that a high degree of security against malfunctions is guaranteed at the same time. Such malfunctions could occur in the household appliance if the signal exchange between the accessory part and the electric control system occurs wirelessly and the accessory part also continues to exchange signals with the electric control system in its resting position. This is effectively prevented by the solution of the invention. At the same time, the accessory part remains within reach, so that operating comfort is not impaired. This also ensures that the accessory part is not misplaced. This, however, would be quite conceivable if the accessory part, for the reasons mentioned above, were removed from the household appliance after use and stored in a different location. On the one hand, this further facilitates the user's access to the accessory part, because the door to the handling space is generally located on the side of the household appliance facing the user in the active position of the household appliance. On the other hand, the number of components can be minimized and, as a result, the design can be simplified as a result of the use of the metal door element for the storage element.

One especially advantageous development of the technical character of the invention provides that the storage element electrically shields the transmission or transmission/reception equipment of the accessory part in all spatial directions. This effectively prevents the aforementioned malfunctions in nearby household appliances that also feature radio paths for signal transmission.

Another advantageous development provides that the storage element completely encloses the accessory part in its resting position, with the exception of a handle for operating the accessory part. This ensures, on the one hand, that no signal exchange between the accessory part and the electric control system can occur in the resting position. On the other hand, ease of operation is further improved, because the user can access the accessory part without additional tools and convey it from the resting position back into the active position.

Another advantageous development provides that, when the door is closed, access to the accessory part is obstructed by the body of the household appliance and made possible when the door is open. This ensures that the accessory part is effectively protected against unwanted access and, at the same time, against loss.

Another advantageous development provides that a removal aid, which facilitates access to the accessory part when the accessory part is in its resting position, is arranged on the storage element and/or the accessory part. As a result, handling of the accessory part is further simplified and ease of operation is additionally increased.

BRIEF DESCRIPTION OF THE DRAWINGS

An exemplary embodiment of the invention is shown in schematic form in the drawings and is described in greater detail below.

DETAILED DESCRIPTION OF THE INVENTION

Figure 1:
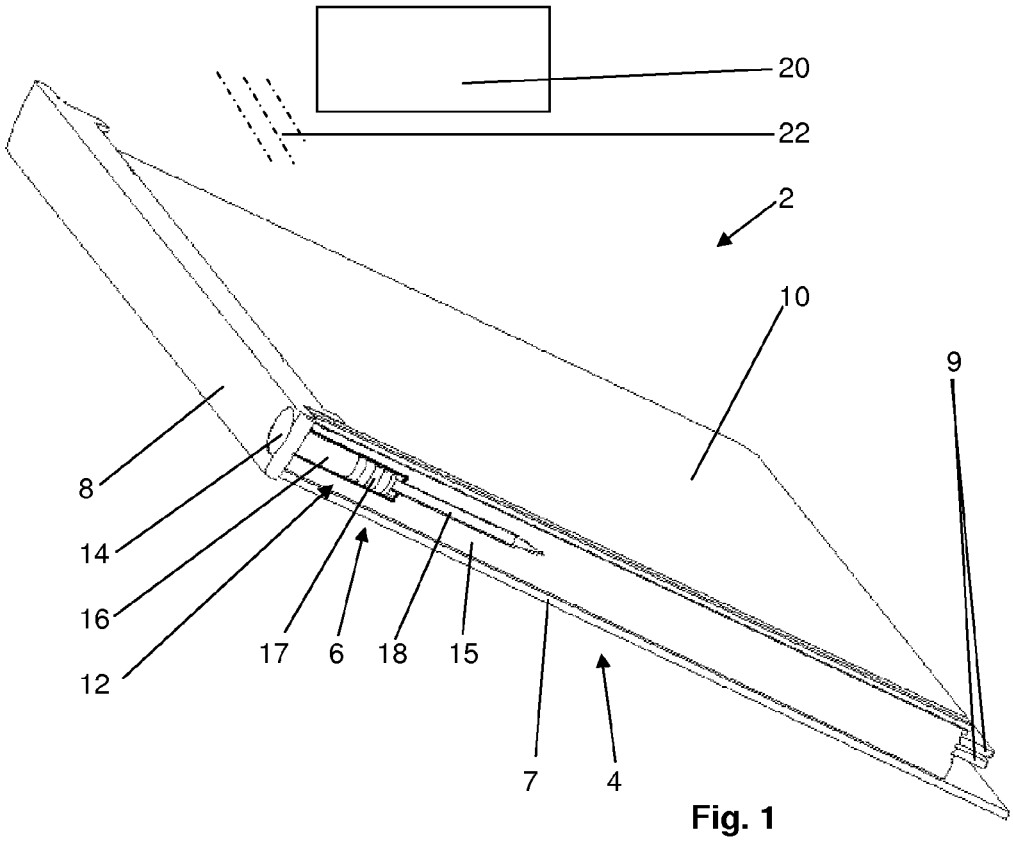
FIG. 1 shows a household appliance according to the invention with an accessory part in its resting position, in partial and perspective view.

A partial view of a household appliance according to the invention is shown in FIG. 1. The household appliance is designed as an oven and has a door 2 that closes off the handling space, namely the baking compartment, which is not shown. The door 2, only partly shown in the figures, has a door frame 4, which has two parallel, spaced side rails 6, only one of which is shown in FIG. 1. The side rails 6 are designed as aluminum extruded profiles and are glued to the exterior panel 7. A plastic upper terminal rail 8 is screwed to the side rails 6. The lower edge of the door frame 4 is formed by a lower, plastic terminal rail, not shown in the figures. The upper terminal rail 8 and the lower terminal rail are attached to the two aluminum extruded profiles 6 by means of molded aluminum corner elements, which are not shown. Center panels 9 and an inner panel 10 are secured to the door frame in a manner known to the person skilled in the art.

The accessory part 12 designed as a temperature pin is shown in its resting position in FIG. 1. With the exception of a handle 14 for operation, the accessory part 12 is inserted completely into the aluminum extruded profile 6, located at the front in the image plane, which features a hollow space 15 for this purpose. So that the most important components can be seen, the aluminum extruded profile 6 is shown in cross-section in FIG. 1 and FIG. 2. The accessory part 12 has a handle section 16 and an insertion pin section 18, with which, in its active position, it is inserted into the cooking material (not shown) located in the handling space. At least one temperature sensor (not shown) is arranged in the insertion pin 18, and said sensor measures the internal temperature of the substance being cooked, a piece of meat, for example, during the cooking process. In the active position of the temperature pin 12, the signal generated in this process is wirelessly transmitted, by means of a transmission device 17 integrated into the handle section 16, to a reception device of an electric control system 20 integrated into the oven and used to control the baking compartment temperature in a manner known to the person skilled in the art.

In this exemplary embodiment, the transmission device 17 features a surface acoustic wave component, which is known in the art, to minimize the space requirements in the temperature pin 12. In the active position of the temperature pin 12, signals transmitted by the electric control system 20 excite vibrations in the surface acoustic wave component that are modified as a factor of the internal temperature of the cooking material and in turn generate signals that, in the active position of the temperature pin 12, are transmitted from the transmission device 17 to the electric control system 20, in which they are further processed in a manner known in the art. Accordingly, when the household appliance is switched on, the electric control system 20 constantly transmits signals 22 for the accessory part 12 at predetermined time intervals. In other words, the transmission device 17 is also a reception device in this case.

According to the invention, however, a signal exchange between the transmission device 17 of the accessory part 12 and the reception device of the electric control system 20 is prevented in the resting position, shown in FIG. 1, of the accessory part 12 designed as a temperature pin. In this case, this is achieved in that in its resting position, the accessory part 12, with the exception of the handle 14, is located entirely in the interior of one of the aluminum extruded profiles 6. All but one side of the transmission device 17 integrated into the handle section 16 is completely enclosed by the aluminum extruded profile 6 and a molded aluminum corner element used to secure the lower covering rail. As a result, the transmission device 17 and, therefore, the accessory part 12, is electrically shielded from the electric control system 20 in a constructively simple manner, because the aluminum extruded profile 6, which forms the storage apparatus, and the molded aluminum corner element are electrically conductive.

The aforementioned arrangement of the storage element 6 has the further advantage that access to the accessory part 12 in its resting position while the door 2 is closed is easily prevented without further structural measures or components, because when the door 2 is closed the upper covering rail 8 is completely covered by the body of the oven (not shown), leaving only a small gap between the body and the door 2.

As a rule, however, it is sufficient if only the part of the side rail 6 that forms the storage element is made of electrically conductive material. In addition, only the transmission device 17 must be electrically shielded, and only to the extent necessary to block the radio path between the electric control system 20 and the accessory part 12.

It would thus be conceivable, according to another exemplary embodiment, which is not explained in detail here, that only the side rail, which is to accept the accessory part in its resting position, be made of aluminum or another electrically shielding material. The remaining parts, such as the upper and lower terminal rails, the molded corner elements for connecting the abovementioned terminal rails to the side rails, and also the other side rail, could be made of an electrically non-shielding material, such as plastic. The molded corner elements could also be eliminated entirely if the aforementioned terminal rails were connected to the side rails or the exterior panel in a different manner. For example, the lower terminal rail could also be eliminated to allow for a ventilated door. Thus, the structure of the door frame is flexible within appropriate limits, provided the radio path between the accessory part and the electric control system of the household appliance is blocked in the resting position of the accessory part. In a qualitatively higher-quality embodiment, the radio path between the accessory part and adjacent household appliances would have to be blocked in the resting position.

In this exemplary embodiment, an embodiment of the storage element 6 was selected that would also electrically shield the transmission device 17 of the accessory part 12 in the resting position against other household appliances installed nearby. The other household appliances are not shown. This is accomplished in that, as explained earlier, all but one side of the transmission device 16 is completely enclosed by the aluminum extruded profile 6 and one of the molded aluminum corner elements. On the remaining side, the aluminum extruded profile 6 features an opening through which the accessory part 12, as will be explained in greater detail below on the basis of FIG. 2, can be inserted. In order to achieve, if necessary, electrical shielding of the accessory part 12 in its resting position on this side, the upper end of the handle section 16 can also be partly made of an electrically conductive material.

Figure 2:
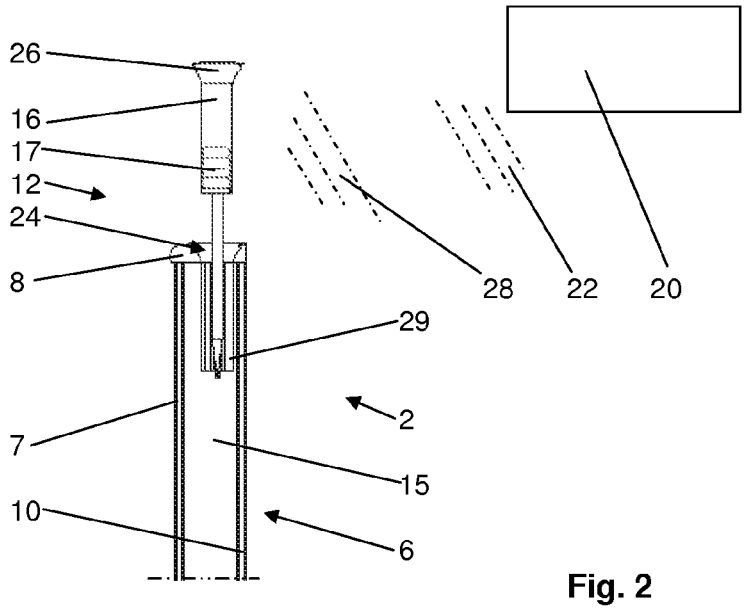
FIG. 2 shows the household appliance from FIG. 1 with the accessory part during conveyance from the resting position into the active position.

FIG. 2 shows the accessory part 12 during conveyance from the resting position shown in FIG. 1 to the active position already explained farther above.

In the position of the accessory part 12 shown in FIG. 2, the handle section 16, in which the transmission device 17 is integrated, is pulled out of the aluminum extruded profile 6 so that the radio path between the transmission device 17 and the electric control system 20 is no longer blocked. The radio path is indicated here by the symbols 22 and 28.

To mount the accessory part 12, designed as a temperature pin, a mounting bag 29 is arranged on the upper covering rail 8, said bag being disposed in the hollow space 15 of the aluminum extruded profile 6 when the door 2 is in the assembled state. Because the upper covering rail 8 is made of plastic here, the mounting bag 29 is molded onto the upper covering rail 8.

As is clearly evident in FIG. 2, the upper terminal rail 8 features a cone-shaped access opening 24 corresponding to the opening in the aluminum extruded profile 6, to which access opening the shape of the upper end of the handle section 16 of the temperature pin 12 corresponds. To facilitate the handling of the temperature pin 12 during conveyance from the resting position to the active position, the cone-shaped expansion 26 at the upper end of the handle section 16 is not completely inserted into the door frame 4 in the resting position of the temperature pin 12. As a result, the handle section 16 can be easily gripped at its expanded point 26. The use of tools is not required.

Alternatively or additionally, it would also be conceivable to provide a removal aid on the accessory part 12 or on the storage element 6. For example, a protrusion arranged on the upper end of the accessory part 12 would be a simple execution of a removal aid. Another possible removal aid could be designed to resemble the mechanics, known in the art, of operating toggles than are retractable into a control panel. In this case, pressure exerted on the accessible face of the operating toggle would cause the toggle, as a result of an elastic force, to be moved from the retracted position, in which the face is flush with the control panel, to a raised position relative to the control panel.

The invention is not limited to the above exemplary embodiment. Instead, other household appliances with radio transmission paths, with and without doors, are conceivable. For example, the use of the solution of the invention would also be possible in microwave devices, steamers, extractor hoods, ceramic stove tops, beverage dispensers, refrigeration devices and laundry treatment machines. The nature of the accessory part is just as diverse as the possible household appliances. Instead of a temperature pin, other sensors that measure a physical or chemical variable of an object to be treated with a household appliance could be integrated into the accessory part of a household appliance according to the invention. Also conceivable is the use of carrying elements or the like that are temporarily placed into a handling space, such as the baking compartment of a cooking device, the presence of which in the handling space should be automatically detectable and capable of being used to control the household appliance. The above embodiments clearly show that the form of the accessory part is freely selectable within broad, suitable limits.

What is claimed is:

1. A household appliance comprising an electric control system, which is connected to an accessory part in a signal-transmitting fashion, wherein the accessory part can be moved back and forth between an active position and a resting position on the household appliance and, in the switched-on state of the household appliance, exchanges signals for controlling the household appliance with the electric control system, at least in the active position, wherein the signal exchange between a transmission or transmission/reception device of the accessory part and the electric control system occurs wirelessly, and the accessory part, in its resting position, is mounted in a storage element of the household appliance at least partly consisting of an electrically conductive material, said storage element electrically shielding the transmission or transmission/reception device of the accessory part from the electric control system so that signal exchange is prevented, and the household appliance comprises a door closing off a handling space, the door having a metal door element and the storage element being integrated in the metal door element.

2. A household appliance according to claim 1, wherein the storage element electrically shields the transmission or transmission/reception device of the accessory part in all spatial directions.

3. A household appliance according to claim 1 wherein the storage element completely encloses the accessory part in its resting position, with the exception of a handle for operating the accessory part.

4. A household appliance according to claim 2 wherein the storage element completely encloses the accessory part in its resting position, with the exception of a handle for operating the accessory part.

5. A household appliance according to claim 1, wherein access to the accessory part when the door is closed is prevented by the body of the household appliance and made possible when the door is opened.

6. A household appliance according to claim 2, wherein access to the accessory part when the door is closed is prevented by the body of the household appliance and made possible when the door is opened.

7. A household appliance according to claim 3, wherein access to the accessory part when the door is closed is prevented by the body of the household appliance and made possible when the door is opened.

8. A household appliance according to claim 4, wherein access to the accessory part when the door is closed is prevented by the body of the household appliance and made possible when the door is opened.

9. A household appliance according to claim 1, wherein a removal aid is arranged on the storage element and/or the accessory part which simplifies access to the accessory part in its resting position.

10. A household appliance according to claim 2, wherein a removal aid is arranged on the storage element and/or the accessory part which simplifies access to the accessory part in its resting position.

11. A household appliance according to claim 3, wherein a removal aid is arranged on the storage element and/or the accessory part which simplifies access to the accessory part in its resting position.

12. A household appliance according to claim 4, wherein a removal aid is arranged on the storage element and/or the accessory part which simplifies access to the accessory part in its resting position.

13. A household appliance according to claim 5, wherein a removal aid is arranged on the storage element and/or the accessory part which simplifies access to the accessory part in its resting position.

14. A household appliance according to claim 6, wherein a removal aid is arranged on the storage element and/or the accessory part which simplifies access to the accessory part in its resting position.

15. A household appliance according to claim 7, wherein a removal aid is arranged on the storage element and/or the accessory part which simplifies access to the accessory part in its resting position.

16. A household appliance according to claim 8, wherein a removal aid is arranged on the storage element and/or the accessory part which simplifies access to the accessory part in its resting position.

* * * * *